United States Patent [19]

Ikeya et al.

[11] Patent Number: 4,586,560

[45] Date of Patent: May 6, 1986

[54] DIE-CASTING METHOD AND APPARATUS

[75] Inventors: Seizi Ikeya, Kariya; Tsuyoshi Tabuchi, Hekinan, both of Japan

[73] Assignee: Nippondenso Co., Ltd., Kariya, Japan

[21] Appl. No.: 736,762

[22] Filed: May 22, 1985

[30] Foreign Application Priority Data

May 24, 1984 [JP] Japan ..... 59-106172

[51] Int. Cl.[4] ..... B22D 17/14; B22D 17/32

[52] U.S. Cl. ..... 164/457; 164/65; 164/133; 164/155; 164/257; 164/305

[58] Field of Search ..... 164/457, 65, 253, 133, 164/113, 305, 312, 155, 61, 254

[56] References Cited

U.S. PATENT DOCUMENTS

| | | | |
|---|---|---|---|
| 3,542,330 | 11/1970 | Wirtz | 164/305 |
| 4,146,081 | 3/1979 | Reis | 164/155 |
| 4,347,889 | 9/1982 | Komatsu et al. | 164/113 |
| 4,431,047 | 2/1984 | Takeshima et al. | 164/253 |
| 4,463,793 | 8/1984 | Thurner | 164/305 |

FOREIGN PATENT DOCUMENTS

| | | | |
|---|---|---|---|
| 1458151 | 1/1969 | Fed. Rep. of Germany | 164/322 |
| 15421 | 2/1979 | Japan | 164/155 |
| 55-129548 | 9/1980 | Japan | 164/65 |
| 131055 | 10/1981 | Japan | 164/61 |

*Primary Examiner*—Nicholas P. Godici
*Assistant Examiner*—Samuel M. Heinrich
*Attorney, Agent, or Firm*—Cushman, Darby & Cushman

[57] ABSTRACT

A die-casting apparatus is used to carry out a die-casting method in which an injection plunger is moved forwardly at a lower speed and then is temporarily stopped at a forward stroke intermediate position in which a space defined by the injection plunger and an injection sleeve is substantially filled with an amount of molten metal. Then, evacuation of a product cavity and the injection sleeve is commenced and, after the lapse of a predetermined time period, the injection plunger is again moved forwardly at a higher speed to inject the molten metal from the injection sleeve into the product cavity. Compared with the prior art, the method provides an increased evacuation time period and assures a reduction in the volume to be evacuated. In addition, the higher injection stroke reduces possibility that air and gases are trapped in the molten metal to provide die-cast products of a high quality.

8 Claims, 4 Drawing Figures

DIE-CASTING METHOD AND APPARATUS

BACKGROUND OF THE INVENTION

The present invention relates to die-casting method and apparatus suited for use in the production of products of metals such as, for example, aluminium.

DESCRIPTION OF THE PRIOR ART

In general, production of articles by die-casting often suffers from a problem that holes or voids are formed in the die-cast products due to the fact that air and other thermally decomposed gases in the die cavity defined by stationary and movable dies and in the injection sleeve are trapped in the molten metal.

In order to obviate this problem, it has been proposed that the die cavity and the space in the injection sleeve be evacuated to remove air and gases therefrom. In most cases, the evacuation is commenced at a moment immediately after the injection plunger has closed the molten metal charging port of the injection sleeve in the injection stroke. At this moment, there still remains a large vacant space defined by the injection sleeve and the plunger, so that the evacuating system has to extract air and other gases not only from the die cavity but also from the vacant space in the injection sleeve. Consequently, the evacuation system is required to have a large capacity. In addition, the time required to obtain a desired level of vacuum is increased due to the necessity for the evacuation of the space in the injection sleeve.

In the prior art, the die cavity is kept at a reduced pressure from the time when the molten metal charging port is closed by the advancing injection plunger to the time when the injection of the molten metal is completed. In other words, the time length needed to obtain the reduced pressure in the die cavity depends on the time length required for the forward stroke of the injection plunger after it has passed the molten metal charging port. Therefore, if the latter time length is short, the die cavity cannot be evacuated to the desired vacuum level.

Even if the die cavity can be evacuated to establish a vacuum therein, the vacuum is liable to be broken by the air flowing through gaps between the stationary and movable dies and clearances between the movable die and ejector pins extending movably through holes in the movable die before the molten metal is injected into the die cavity.

The disclosure in Japanese Pre-Examination Utility Model Publication No. 129548/1980 is generally related to the subject matter of the present application.

SUMMARY OF THE INVENTION

According to one feature of the present invention, there is provided a method of die-casting an article of a metal by injecting molten metal from an injection sleeve by an injection plunger into a product cavity defined by movable and stationary dies which cooperate to define a suction channel arranged adjacent to the product cavity and communicated with the product cavity through a suction vent passage of a cross-section small enough to block the passage of the molten metal therethrough, the method comprising the steps of:

charging a quantity of the molten metal into a spaced defined by the injection sleeve and plunger;

moving the injection plunger forwardly at a lower speed in the injection sleeve while the product cavity is communicated with the atmosphere until a position is reached in which the volume defined by the injection sleeve and plunger is substantially filled with the molten metal;

temporarily stopping the forward movement of the injection plunger substantially at the said position;

interrupting the communication between the product cavity and the atmosphere and simultaneously communicating the product cavity with a vacuum source through a vacuum gate and a vacuum runner so that the product cavity is evacuated through the vacuum gate and vacuum runner by the vacuum source;

after the lapse of a predetermined time period, interrupting the communication between the product cavity and the vacuum source through the vacuum gate and runner and communicating the product cavity through the suction vent passage and the suction channel with the vacuum source to keep the product cavity evacuated by the vacuum source; and again moving the injection plunger forwardly at a higher speed so that the molten metal in the injection sleeve is injected therefrom into the product cavity.

According to another feature of the present invention, there is provided an apparatus for die-casting an article of a metal, comprising:

a stationary die;

a movable die movable into face-to-face engagement with the stationary die to cooperate therewith to define a product cavity, a suction channel arranged adjacent to the product cavity and suction vent passage communicating the product cavity with the suction channel;

an injection sleeve communicated with the product cavity and adapted to receive a quantity of molten metal;

an injection plunger slidable in the injection sleeve and adapted to be driven forwardly to force the molten metal in the injection sleeve toward the product cavity;

means associated with the injection plunger for detecting a position thereof in which a space defined by the injection sleeve and plunger is substantially filled with the molten metal;

a vacuum source means;

the stationary and movable dies further cooperating to define a vacuum runner and a vacuum gate communicated therewith;

the vacuum source means being adapted to be communicated with the product cavity through the suction channel and suction vent passage and also adapted to be communicated with the product cavity through the vacuum runner and the vacuum gate;

first valve means for controlling the communication between the vacuum source means and the product cavity through the vacuum gate and the vacuum runner;

second valve means having two operative positions in one of which the product cavity is communicated with the vacuum source means through the vacuum gate and vacuum runner as well as through the suction vent passage and said suction channel and in the other of which the product cavity is communicated with the atmosphere through the vacuum gate and vacuum runner as well as through the suction vent passage and the suction groove;

the arrangement being such that the second valve means is kept in the said other position until the detecting means detects the said position of the injection plunger, such that the position of the second valve means is changed over to said one position when said detecting means detects the position of the injection plunger, such that, after the lapse of a predetermined time period from the change-over of the position of the second valve means, the first valve means interrupts the communication between the vacuum means and the product cavity through the vacuum gate and vacuum runner and the injection plunger is further driven forwardly to inject the molten metal from the injection sleeve into the product cavity;

the suction vent passage including a suction vent section of a cross-section small enough to block the passage of the molten metal therethrough.

The present invention will be described by way of example with reference to the accompanying drawings.

DESCRIPTION OF THE PREFERRED EMBODIMENT

Figure 1:
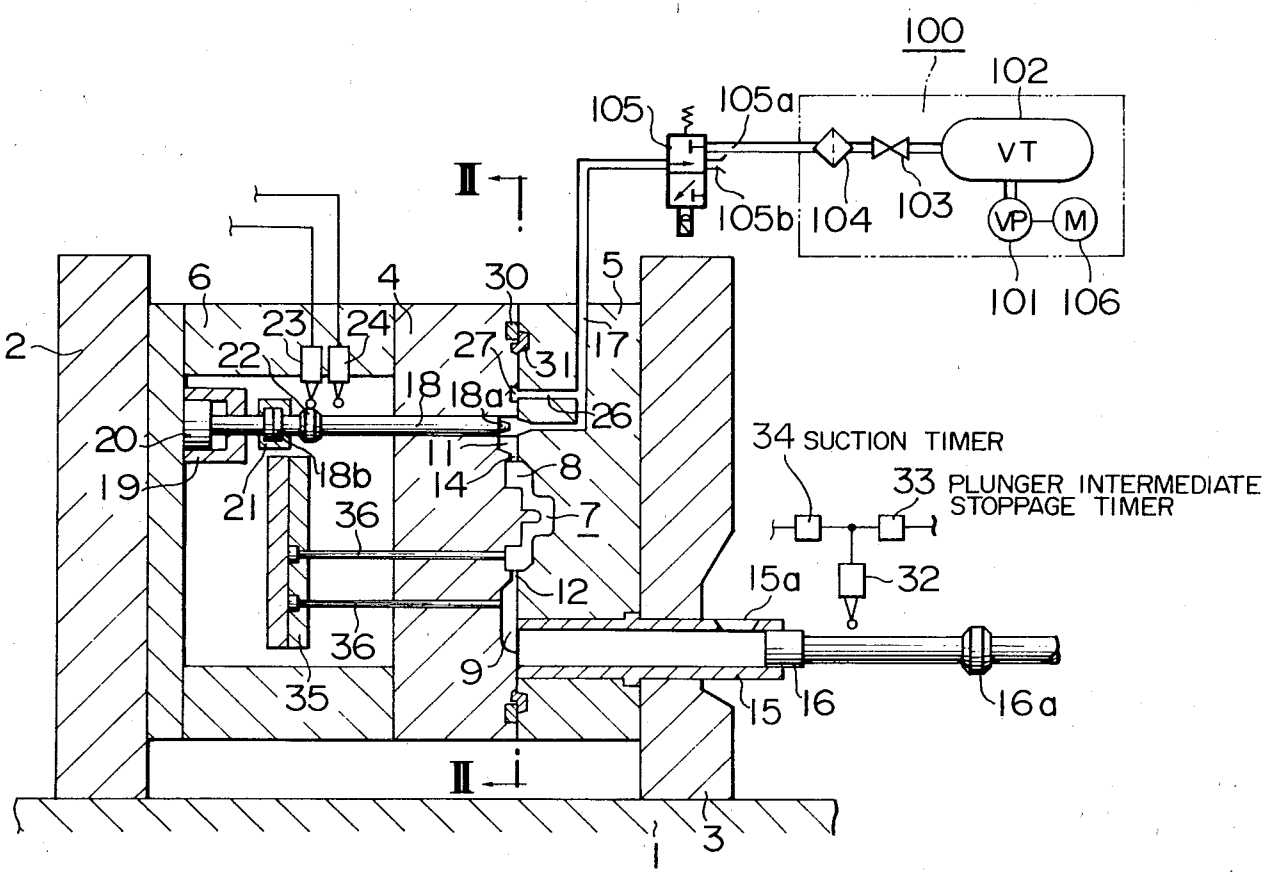
FIG. 1 is a sectional view of an embodiment of the die-casting apparatus in accordance with the invention.

FIG. 1 shows an embodiment of a die-casting apparatus of the invention in a state in which movable and stationary dies 4 and 5 are brought together to define a die cavity. The die-casting apparatus has a movable platen 2 mounted on a stationary base 1 and adapted to be moved to the left and right as viewed in FIG. 1 by the action of a hydraulic cylinder which is not shown. The movable platen 2 has its one side fixed to a die base 6 which in turn is secured to the movable die 4.

A stationary platen 3 is fixed to the stationary base 1 and carries the above-mentioned stationary die 5 fixed thereto. The arrangement is such that, when the movable die 4 is moved to the right, as viewed in FIG. 1, into contact with the stationary die 5, a die cavity generally designated by numeral 7 is defined between both dies 4 and 5. The die cavity 7 includes several cavity portions such as a product cavity 8 for forming the article to be produced, a runner 9 through which molten material is introduced into the product cavity 8 through a runner gate 12, overflow wells 10 for receiving the molten material overflowing the product cavity, overflow gates 13 providing communication between the product cavity 8 and the overflow wells 10, a vacuum runner 11 through which the product cavity is connected to a vacuum source to be described, and a vacuum runner gate 14 through which the vacuum runner 11 is communicated with the product cavity 8.

The runner 9 is communicated with one end of the space in a cylindrical injection sleeve 15 which is fixedly mounted in the stationary die 5 and the stationary platen 3. The other end of the space in the injection sleeve 15 is opened to slidably receive an injection plunger 16.

A batch of molten metal is charged into the injection sleeve 15 through a molten metal charging port 15*a* formed therein adjacent to the end which is remote from the runner 9. Then, the injection plunger 16 is driven forwardly, i.e., to the left, as viewed in FIG. 1, by the action of a conventional hydraulic system which is not shown, so that the molten metal is forced into the product cavity 8 through the runner 9 and the runner gate 12 to fill not only the product cavity 8 but also other portions of the die cavity 7 such as the overflow gate 13, the overflow wells 10, the vacuum gate 14 and the vacuum runner 11.

A cut-off suction passage 17 is formed in the stationary die 5 and connected at its one end to the vacuum runner 11 and at its other end to an evacuating or vacuum system generally designated by numeral 100. A solenoid valve 105 is disposed in the cut-off suction passage 17 and acts as a change-over valve having two positions in one of which it allows the cut-off suction passage 17 to be communicated with the vacuum system 100 and in the other of which the valve allows the cut-off suction passage to be communicated with the atmosphere. The vacuum system 100 includes a vacuum pump 101, a vacuum tank 102 for storing the vacuum created by the vacuum pump 101, a manual valve 103 for closing the passage between the vacuum tank and the solenoid valve 105 as desired, an air filter 104 for removing foreign particles suspended by the air flowing through the cut-off suction passage 17 toward the tank 102, and a motor 106 for driving the vacuum pump 101.

A cut-off pin 18 which serves as a valve means extends slidably through a bore formed in the movable die 4 such that its one end 18*a* faces the juncture between the cut-off suction passage 17 and the vacuum runner 11. The other end 18*b* of the cut-off pin 18 is coupled through a coupling 21 to a piston 20 disposed in a cylinder 19. The piston 20 is slidably movable within the cylinder 19 by hydraulic pressure so that the end 18*a* of the cut-off pin 18 selectively controls the communication between the vacuum runner 11 and the cut-off suction passage 17.

A collar 22 having a diameter greater than the diameter of the cut-off pin 18 is fixed to a substantially mid portion of the cut-off pin 18. When the cut-off pin 18 moves backwardly and forwardly, backward and forward position limit switches 23 and 24, which are fixed to the die base 6, are contacted by the collar 22 to detect the backward and forward positions of the cut-off pin 18, respectively.

Figure 2:
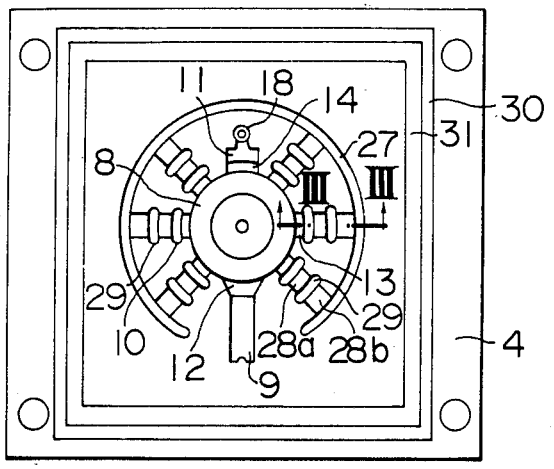
FIG. 2 is a front elevational view of a movable die taken along line II—II in FIG. 1.
Figure 3:
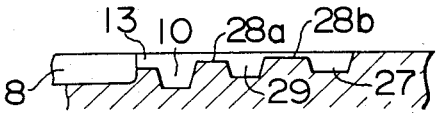
FIG. 3 is an enlarged fragmentary sectional view taken along line III—III in FIG. 2.

As will be best seen in FIG. 2, the contact surface of the movable die 4 is formed therein with a suction groove 27 which has the form of a part of a circle surrounding the product cavity 8. The suction groove 27 is communicated with each of the overflow wells 10 (six wells in the illustrated embodiment) through a first suction vent 28*a*, a suction vent well or reservoir 29, and a second suction vent 28*b*. Referring also to FIG. 3, the product cavity 8 is communicated with the suction groove 27 through six passages each formed by, as viewed from the radially inner side to the outer side, the overflow gate 13, the overflow well 10, the first suction vent 28*a*, the suction vent reservoir 29 and the second suction vent 28*b*. It will be also seen that the depth of the overflow gate 13 is greater than the depth of the first suction vent 28*a* which in turn is greater than the depth of the second suction vent 28*b*. Similarly, the overflow well 10 has a depth greater than the depth of the suction vent reservoir 29 which in turn is greater than the depth of the suction groove 27.

When the dies 4 and 5 are closed, the suction groove 27 is communicated with the cut-off suction passage 17 through a communication passage 26 which is formed in the stationary die 5. Thus, the suction groove 27 is connected to the vacuum system 100 through the communication passage 26, the cut-off suction passage 17 and the solenoid 105. The suction groove 27 can be called "suction channel".

The gases produced by air and thermal decomposition of lubricant in the die cavity 7 and the injection sleeve 15 are sucked by the vacuum system 100 through the vacuum runner 11, the cut-off suction passage 17 and the solenoid valve 105. The gases are also sucked by the vacuum system 100 through the overflow gates 13, the overflow wells 10, the suction vents 28*a*, the suction vent reservoirs 29, the suction vents 28*b*, the suction groove 26, the passage 26 and the cut-off suction passage 17.

A sealing rubber 30 is fixed by a mounting member 31 to the contacting surface of the movable die 4 to encircle the die cavity 7, the suction groove 27 and the forward opening of the injection sleeve 15 so that the space inside the sealing rubber 30 is sealed from the atmosphere when both dies 4 and 5 are brought together.

A reference numeral 32 appearing in FIG. 1 denotes an intermediate stop limit switch (detecting means) provided outside the dies. The arrangement is such that, when the injection plunger 16 has reached an intermediate position where it is to be stopped, the limit switch 32 is actuated by a collar 16*a* provided on the injection plunger 16 to detect the arrival of the injection plunger 16 at the intermediate stopping position. A timer 33 is electrically connected to the limit switch 32 to control the time length of the stoppage of a forward movement of the injection plunger 16 at the intermediate position thereof. A suction timer 34 is electrically connected to the solenoid valve 105 to control the durations of opening and closing of the solenoid valve 105.

Ejector pins 36 extend through bores formed in the movable die 4 at positions opposing the die cavity 7. The ejector pins 36 are fixed to an ejector plate 35 which is adapted to be driven back and forth by a hydraulic device which is not shown. After the movable die 4 is moved away from the stationary die 5, the ejector pins 36 are projected into the die cavity 7 to eject a cast article from the die cavity.

The embodiment having the described construction operates in a manner which will be explained hereinunder.

First of all, the piston 20 is moved to the left as viewed in FIG. 1 to retract the cut-off pin 18. The retraction is confirmed by the operation of the backward position limit switch 23. Then, the movable die 4 is moved into face-to-face contact with the stationary die 5.

Figure 4:
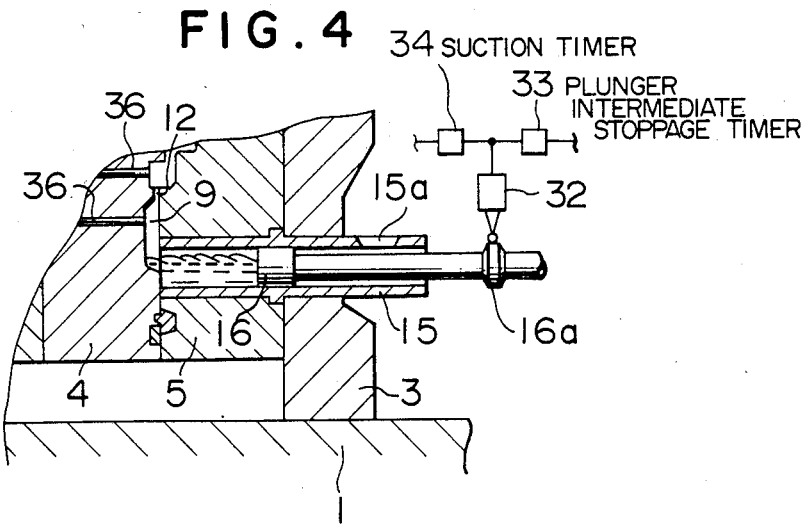
FIG. 4 is a fragmentary sectional view of the apparatus illustrating the operation thereof.

Subsequently, a molten metal is charged into the injection sleeve 15 through the molten metal charging port 15*a*. The injection plunger 16 is then driven forwardly, i.e., to the left as viewed in FIG. 1 at a low speed of 0.1 to 0.2 m/sec so that air in the injection sleeve is prevented from being trapped in the molten metal and that the molten metal is prevented from coming into the runner 9. When the plunger in its forward stroke has passed and blocked the molten metal charging port 15*a* and the molten metal forced by the injection plunger 16 occupies about 80 to 100% of the space defined by the injection sleeve 15 and the end of the injection plunger 16, the position of the injection plunger 16 at this moment is detected by the aforementioned intermediate stop limit switch 32 so that the injection plunger 16 is temporarily stopped at this position. This position of the apparatus is shown in FIG. 4 from which it will be seen that a part of the molten metal has come into the portion of the runer 9 facing the injection sleeve 15.

During the forward movement of the injection plunger 16, the cut-off pin 18 is kept at the retracted position and the solenoid valve 105 opens the passage to the atmosphere which is represented by a port 105*b* open to the atmosphere. Therefore, a part of the air and the gases produced by thermal decomposition of lubricant in the die cavity 7 and the injection sleeve 15 is exhausted out of the cavity 7 and the sleeve 15 to the atmosphere through the vacuum runner gate 14, the vacuum runner 11, the cut-off suction passage 17 and the solenoid valve 105 by the forward movement of the injection plunger 16.

When the injection plunger 16 is stopped at the intermediate position by the operation of the intermediate stop limit switch 32, the plunger stoppage timer 33 and the suction timer 34 start to operate. At the same time, the solenoid valve 105 is operated by the detection signal from the intermediate stop limit switch 32 to disconnect the cut-off suction passage 17 from the port 105*b* to a vacuum passage 105*a* leading to the vacuum system 100. In consequence, the air and the gases in the cavity 7 and the sleeve 15 are sucked therefrom by the vacuum system 100 through the vacuum runner gate 14, the vacuum runner 11, the cut-off suction passage 17 and the solenoid valve 105. At this time, more than 80% of the space defined by the injection sleeve 15 and the injection plunger 16 are filled with the molten metal, so that there is no subtantial residual or vacant space in the sleeve 15. This means that the volume of the vacant space in the injection sleeve can be substantially ignored and, therefore, the vacuum system 100 is required to evacuate almost only the die cavity 7. Thus, the load on the vacuum system 100 can be decreased correspondingly. It is, therefore, possible to reduce the size and capacity of the vacuum system as compared with the conventional apparatus.

In the prior art apparatus, the vacuum established in the die cavity by the operation of a vacuum system may possibly be broken by air introduced through a clearance between an injection plunger and an injection sleeve. This problem, however, is overcome by the present invention because, when the evacuating operation is commenced, 80 to 100% of the space in the injection sleeve 15 have been filled with the molten metal which also fills such a clearance to block the entrance of air.

It is to be noted also that, if the space in the injection sleeve 15 were filled with the molten metal completely (100%), a part of the molten metal would be sucked by vacuum and flow through the runner 9 into the runner gate 12 and would solidfy therein. The apparatus of the invention is free from this problem because the space in the injection sleeve 15 is not filled up with the molten metal. Taking this fact into account, the expression of "filling of the space defined by the injection plunger and the injection sleeve with the molten metal" should be understood to mean that this space is occupied by the molten metal to about 80 to 100% of the volume of the space.

After the lapse of the time period set in the plunger stoppage timer 33, which is about 1 second in the embodiment, the piston 20 is moved to the right, as viewed in FIG. 1, to drive the cut-off pin 18 forwardly to cause the same to interrupt the communication between the vacuum runner 11 and the cut-off suction passage 17. After the interruption has been detected by the forward position limit switch 24 which detects the cut-off pin 18 reaching the forward stroke end, the injection plunger 16 is again driven forwardly at a high speed to inject the molten metal from the space in the injection sleeve 15 into the cavity 7. Thus, the molten metal is completely prevented from flowing into the cut-off suction passage 17.

The vacuum system 100 is continuously operated even during the time period from the moment the communication between the vacuum runner 11 and the cut-off suction passage 17 is interrupted by the cut-off pin 18 to the moment when the injection is completed. Thus, the product cavity 8 is continuously evacuated by the vacuum system 100 through the overflow gates 13, the overflow wells 10, the suction vents 28*a*, the suction vent reservoirs 29, the suction vents 28*b* and the suction groove 27. As a result, the air and gases remaining in the die cavity 7 and the air induced from outside the die cavity during the injection are sucked by the vacuum system 100, so that a high vacuum level is maintained in the die cavity 7.

The solenoid valve 105 maintains the communication between the cut-off suction passage 17 and the vacuum system 100 for a predetermined time period (3 to 4 seconds in this embodiment) set in the suction timer 34 and, after the lapse of this time period, the valve 105 connects the cut-off suction passage 17 to the atmosphere 105*b*. The injection of the molten metal into the product cavity 7 is completed while the solenoid valve 105 communicates the passage 17 with the vacuum system 100.

After the molten metal injected into the die cavity 7 is solidified, the movable die 4 is moved to the left, as viewed in FIG. 1, to open the die cavity and the ejector pins 36 are then projected into the product cavity 8 to eject the solidified product.

The operation described above will be repeated cyclically so that articles are die-cast successively.

The described embodiment offers the following advantages:

(1) Because a part of the detrimental gases produced by thermal decomposition of the lubricant contacting the molten metal is discharged to the atmosphere, the amount of the gases to be sucked into the vacuum system 100 is reduced with a resultant increase in the operative life of the system 100.

(2) Because injection plunger 16 is moved forwardly at a low speed of 0.1 to 0.2 m/sec, the air and the gases in the injection sleeve 15 are prevented from being trapped in the molten metal before the air and gases are sucked by vacuum.

(3) The evacuation is started after 80 to 100% of the space in the injection sleeve 15 have been filled with the molten metal. Therefore, the total volume to be evacuated is reduced so that the capacity and the size of the vacuum system 100 can be reduced and the evacuating time can be shortened advantageously.

(4) The suction circuit between the vacuum runner gate 14 and the vacuum system 100 is designed to have a large cross-sectional area, so that the flow resistance along this circuit is decreased to facilitate a high evacuation effect in a short time.

(5) Because the injection plunger 16 is temporarily stopped at the intermediate position of its forward stroke, the time duration of the evacuation can be freely set.

(6) Because the injection is started only after the confirmation of the interruption of communication between the vacuum runner 11 and the cut-off suction passage 17 by the cut-off pin 18, entrance of the molten metal into the suction circuit can be avoided without fail.

(7) The die cavity 7 can be continuously evacuated through the suction vents 28 even after the communication between the vacuum runner 11 and the cut-off suction passage 17 has been interrupted by the cut-off pin 18, i.e., until the injection is completed, so that the air induced into the die cavity 7 from outside thereof as well as the air and gases in the die cavity 7 can be effectively sucked to assure that a reduced pressure is maintained in the die cavity 7. The suction vents 28*a* and 28*b* are formed to have such small depths (about 0.1 mm in the described embodiment) as not to allow the molten metal to pass therethrough and are arranged in plural. In addition, suction vent reservoirs 29 are provided between the adjacent suction vents 28 to prevent any molten metal from flowing into the suction groove 27. Consequently, the rate of the evacuation can be increased and the tendency for the molten metal to clog the suction passage is suppressed as compared with the conventional arrangement in which the air and gases are sucked through gaps between the ejector pins and the inner surfaces of the bores receiving these pins. In addition, the suction groove 27 surrounds the die cavity and thus permit the suction of air through minute gaps which are inevitably formed between the movable die 4 and the stationary die 5.

The present inventors have conducted a test in which the die-cast product produced by the described embodiment of the die-casting apparatus of the present invention has been compared with the die-cast product made by the prior art apparatus. The product produced by the prior art apparatus had a specific gravity of 2.70 g/cm$^3$ and contained 20 cc of gases per 100 g of aluminum, whereas the product made by the apparatus of the described embodiment of the invention had a specific gravity of 2.74 g/cm$^3$ and contained only 3 cc of gases per 100 g of aluminum. The greater specific gravity means fewer blow holes or voids in the product. The product made by the present invention showed almost no expansion when subjected to a T6 heat treatment.

In another test, die-cast products of 1 mm in thickness were produced by the prior art apparatus and by the apparatus of the described embodiment. The product made by the conventional apparatus showed a surface roughness of 30 $\mu z$ and was cracked when ejected. In contrast, the product by the die-casting apparatus of the described embodiment of the invention showed a surface roughness of 9 $\mu z$ and an allowable, excellent quality. The smaller degree of surface roughness indicates that the running of the molten metal has been appreciably improved.

Although, in the described embodiment, one end of the suction vent 28*a* opens to an overflow well 10, this arrangement is not exclusive and the end of the suction vent 28 may open directly to the product cavity 8.

As will be understood from the foregoing description, according to the die-casting method of the invention, the evacuation of the product cavity and the injection sleeve is commenced only after the space defined by the injection plunger and the injection sleeve is substantially filled with the molten metal. In consequence, the total volume to be evacuated is reduced to allow the vacuum system to be of smaller size and capacity as well as to shorten the time required for the evacuation. The evacuation is conducted during temporary stoppage of the injection plunger. It is, therefore, possible to allocate a sufficiently long time duration for the evacuation by adjusting the duration of the temporary stoppage of the injection plunger.

Furthermore, since the injection of the molten mtal into the product cavity is effected by a rapid forward movement of the injection plunger while the product cavity is being evacuated, it is possible to maintain the desired reduced pressure in the product cavity during the injection. In consequence, the tendency that air and gases are trapped in the molten metal can be reduced and the running of the molten metal is improved to provide die-cast products of a high quality and without any defects such as blow holes and surface wrinkles.

It will be clear to those skilled in the art that the die-casting method of the invention can be carried out easily and effectively by the use of the described embodiment of the die-casting apparatus.

What is claimed is:

1. A method of die-casting an article of a metal by injecting molten metal from an injection sleeve by an injection plunger into a product cavity defined by movable and stationary dies which cooperate to define a suction channel arranged adjacent to said product cavity and communicated with said product cavity through a suction vent passage of a cross-section small enough to block the passage of the molten metal therethrough, said method comprising the steps of:

charging a quantity of the molten metal into a space defined by said injection sleeve and plunger;

moving said injection plunger forwardly at a lower speed in said injection sleeve while said product cavity is communicated with the atmosphere until a position is reached in which the volume defined by said injection sleeve and plunger is substantially filled with the molten metal;

temporarily stopping the forward movement of said injection plunger substantially at said position;

interrupting the communication between said product cavity and the atmosphere and simultaneously communicating said product cavity with a vacuum source through a vacuum gate and a vacuum runner so that said product cavity is evacuated through said vacuum gate and vacuum runner by said vacuum source;

after the lapse of a predetermined time period, interrupting the communication between said product cavity and said vacuum source through said vacuum gate and runner and communicating said product cavity through said suction vent passage and said suction channel with said vacuum souce to keep said product cavity evacuated by said vacuum source; and again moving said injection plunger forwardly at a higher speed so that the molten metal in said injection sleeve is injected therefrom into said product cavity.

2. A die-casting method according to claim 1, wherein said product cavity is communicated with said vacuum source through said suction vent passage and said suction channel at the same time when said product cavity is communicated through said vacuum gate and vacuum runner with said vacuum source.

3. A die-casting method according to claim 2, wherein said injection plunger is stopped when the volume defined by said injection sleeve and plunger is occupied by the molten metal up to a range between 80 to 100% of said volume.

4. An apparatus for die-casting an article of a metal, comprising:

a stationary die;

a movable die movable into face-to-face engagement with said stationary die to cooperate therewith to define a product cavity, a suction channel arranged adjacent to said product cavity and suction vent passage communicating said product cavity with said suction channel;

an injection sleeve communicated with said product cavity and adapted to receive a quantity of molten metal;

an injection plunger slidable in said injection sleeve and adapted to be driven forwardly to force the molten metal in said injection sleeve toward said product cavity;

means associated with said injection plunger for detecting a position thereof in which a space defined by said injection sleeve and plunger is substantially filled with the molten metal;

a vacuum source means;

said stationary and movable dies further cooperating to define a vacuum runner and a vacuum gate communicated therewith;

said vacuum source means being adapted to be communicated with said product cavity through said suction channel and suction vent passage and also adapted to be communicated with said product cavity through said vacuum runner and said vacuum gate;

first valve means for controlling the communication between said vacuum source means and said product cavity through said vacuum gate and said vacuum runner;

second valve means having two operative positions in one of which said product cavity is communicated with said vacuum source means through said vacuum gate and vacuum runner as well as through said suction vent passage and said suction channel and in the other of which said product cavity is communicated with the atmosphere through said vacuum gate and vacuum runner as well as through said suction vent passage and said suction channel;

the arrangement being such that said second valve means is kept in said other position until said detecting means detects said position of said injection plunger, such that the position of said second valve means is changed over to said one position when said detecting means detects said position of said injection plunger, such that, after the lapse of a predetermined time period from the change-over of the position of said second valve means, said first valve means interrupts the communication between said vacuum source means and said product cavity through said vacuum gate and vacuum runner and said injection plunger is further driven forwardly to inject the molten metal from said injection sleeve into said product cavity;

said suction vent passage including a suction vent section of a cross-section small enough to block the passage of the molten metal therethough.

5. A die-casting apparatus according to claim 4, in which said suction vent passage further includes a suction vent well of a cross-section greater than that of said suction vent section.

6. A die-casting apparatus according to claim 5, in which said suction vent passage further includes an additional suction vent section of a cross-section smaller than that of the first-said suction vent section, said suction vent well being disposed between said suction vent sections.

7. A die-casting apparatus according to claim 6, in which said suction vent passage further includes an overflow gate and an overflow well disposed between said product cavity and the first-said suction vent section.

8. A die-casting apparatus according to claim 4, in which said suction channel is arranged to extend substantially around said product cavity and a plurality of such suction vent passages are provided between said suction channel and said product cavity.

* * * * *